US008387206B2

(12) United States Patent
Arthey et al.

(10) Patent No.: US 8,387,206 B2
(45) Date of Patent: Mar. 5, 2013

(54) SURFACE TREATING HEAD

(75) Inventors: Spencer James Robert Arthey, Malmesbury (GB); Stephen Robert Dimbylow, Malmesbury (GB); Alistair William Skuse, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 370 days.

(21) Appl. No.: 12/831,056

(22) Filed: Jul. 6, 2010

(65) Prior Publication Data

US 2011/0010886 A1 Jan. 20, 2011

(30) Foreign Application Priority Data

Jul. 16, 2009 (GB) ..... 0912357.1
Jul. 16, 2009 (GB) ..... 0912359.7
Jan. 21, 2010 (GB) ..... 1000959.5
Jan. 21, 2010 (GB) ..... 1000960.3

(51) Int. Cl.
*A47L 9/04* (2006.01)
*A47L 9/06* (2006.01)

(52) U.S. Cl. ..... 15/365; 15/373

(58) Field of Classification Search ..... 15/365, 15/373, 375, 421; *A47L 5/00*
See application file for complete search history.

(56) References Cited

U.S. PATENT DOCUMENTS 2,703,903 A 3/1955 Faith-ell
3,497,903 A * 3/1970 Jonsson ..... 15/319
3,599,271 A * 8/1971 Ljung et al. ..... 15/259
3,659,312 A 5/1972 Mattsson
3,660,864 A * 5/1972 Schwartz ..... 15/319
3,768,114 A * 10/1973 Schwartz ..... 15/319
3,798,704 A * 3/1974 Kilstrom et al. ..... 15/319
4,180,887 A 1/1980 Wudel et al.
4,336,628 A 6/1982 Bradshaw et al.
4,447,931 A * 5/1984 Lindqvist ..... 15/365
4,564,972 A 1/1986 Varin
4,638,526 A * 1/1987 Murata et al. ..... 15/367
4,888,852 A 12/1989 Varin (Continued)

FOREIGN PATENT DOCUMENTS

CN 1187980 7/1998
DE 26 02 969 7/1977

(Continued)

OTHER PUBLICATIONS

Lambourn, Office Action mailed Jun. 6, 2012, directed to U.S. Appl. No. 12/722,145; 6 pages.

(Continued)

*Primary Examiner* — Brian Glessner
*Assistant Examiner* — Brian D Mattei
(74) *Attorney, Agent, or Firm* — Morrison & Foerster LLP

(57) ABSTRACT

A surface treating head includes a main body; a brush unit; and a drive mechanism for moving the brush unit relative to the main body between a stowed position and a deployed position. The drive mechanism includes a pressure chamber and a valve unit for varying the pressure within the chamber. The valve unit includes a housing, a valve located within the housing and, disposed on the housing, an actuator moveable relative to the housing through engagement with a surface to be treated for operating the valve and at least one surface engaging member extending downwardly beyond the actuator. The housing is moveable relative to the main body to maintain the surface engaging member in contact with the surface to be treated.

34 Claims, 15 Drawing Sheets

U.S. PATENT DOCUMENTS

| | | | | |
|---|---|---|---|---|
| 5,123,141 | A | 6/1992 | Erickson et al. | |
| 5,539,953 | A | 7/1996 | Kurz | |
| 5,553,349 | A * | 9/1996 | Kilstrom et al. | 15/360 |
| 5,564,161 | A | 10/1996 | Glatz | |
| 6,009,594 | A * | 1/2000 | Grey | 15/322 |
| 7,069,620 | B2 | 7/2006 | Bagwell | |
| 7,467,439 | B2 * | 12/2008 | Lijzenga et al. | 15/373 |
| 7,584,522 | B1 | 9/2009 | Weeter et al. | |
| 2003/0163889 | A1 | 9/2003 | Bagwell | |
| 2005/0120512 | A1 | 6/2005 | Choi | |
| 2006/0213026 | A1 * | 9/2006 | Lijzenga et al. | 15/368 |
| 2010/0229339 | A1 | 9/2010 | Lambourn | |
| 2010/0319159 | A1 | 12/2010 | Gell et al. | |
| 2011/0010889 | A1 | 1/2011 | Arthey et al. | |
| 2011/0010890 | A1 | 1/2011 | Dimbylow et al. | |

FOREIGN PATENT DOCUMENTS

| | | |
|---|---|---|
| DE | 31 31 380 | 2/1983 |
| DE | 36 02 926 | 8/1987 |
| DE | 199 33 449 | 11/2000 |
| DE | 203 12 836 | 2/2004 |
| EP | 1 092 380 | 4/2001 |
| EP | 1 320 317 | 6/2003 |
| EP | 1 875 846 | 1/2008 |
| EP | 2 027 805 | 2/2009 |
| FR | 1 545 346 | 11/1968 |
| FR | 1545346 | 11/1968 |
| FR | 2 696 633 | 4/1994 |
| FR | 2 773 317 | 7/1999 |
| FR | 2 792 817 | 11/2000 |
| FR | 2 871 046 | 12/2005 |
| GB | 851185 | 10/1960 |
| GB | 1077574 | 8/1967 |
| GB | 1190219 | 4/1970 |
| GB | 1 289 381 | 9/1972 |
| GB | 1 289 468 | 9/1972 |
| GB | 1 315 024 | 4/1973 |
| GB | 1 328 944 | 9/1973 |
| GB | 1 493 097 | 11/1977 |
| GB | 1 505 783 | 3/1978 |
| GB | 2 381 443 | 5/2003 |
| JP | 48-22430 | 7/1973 |
| JP | 49-1105 | 1/1974 |
| JP | 52-91558 | 8/1977 |
| JP | 54-6359 | 1/1979 |
| JP | 56-9348 | 1/1981 |
| JP | 57-58352 | 4/1982 |
| JP | 58-46553 | 3/1983 |
| JP | 62-184847 | 11/1987 |
| JP | 64-83229 | 3/1989 |
| JP | 4-132530 | 5/1992 |
| JP | 5-261041 | 10/1993 |
| JP | 10-323303 | 12/1998 |
| JP | 11-56710 | 3/1999 |
| JP | 11-276392 | 10/1999 |
| JP | 2004-167268 | 6/2004 |
| JP | 2006-525845 | 11/2006 |
| JP | 2007-54145 | 3/2007 |
| JP | 2008-86550 | 4/2008 |
| JP | 2009-45440 | 3/2009 |
| KR | 10-2004-0105163 | 12/2004 |
| KR | 10-2009-0000937 | 1/2009 |
| WO | WO-99/34721 | 7/1999 |
| WO | WO-02/26097 | 4/2002 |
| WO | WO-02/085174 | 10/2002 |
| WO | WO-2004/105569 | 12/2004 |
| WO | WO-2005/074778 | 8/2005 |
| WO | WO-2005/087072 | 9/2005 |

OTHER PUBLICATIONS

GB Search Report dated Oct. 15, 2009 directed to counterpart application No. GB 0912357.1; 1 page.

GB Search Report dated Oct. 15, 2009 directed to counterpart application No. GB 0912359.7; 1 page.

GB Search Report dated Apr. 28, 2010 directed to counterpart application No. GB1000959.5; 1 page.

GB Search Report dated Apr. 28, 2010 directed to counterpart application No. GB1000960.3; 1 page.

International Search Report and Written Opinion mailed Sep. 16, 2010, directed towards Application No. PCT/GB2010/051071; 9 pages.

Dimbylow et al., U.S. Office Action mailed Aug. 16, 2012, directed to U.S. Appl. No. 12/831,841; 12 pages.

Gell et al., U.S. Office Action mailed Oct. 12, 2012, directed to U.S. Appl. No. 12/813,264; 12 pages.

* cited by examiner

SURFACE TREATING HEAD

REFERENCE TO RELATED APPLICATIONS

This application claims the priority of United Kingdom Application Nos. 0912357.1 and 0912359.7, both filed Jul. 16, 2009, and United Kingdom Application Nos. 1000959.5 and 1000960.3, both filed Jan. 21, 2010, the entire contents of which are incorporated herein by reference.

FIELD OF THE INVENTION

This invention relates to a surface treating head which can be used with, or form part of a surface treating appliance such as a vacuum cleaner.

BACKGROUND OF THE INVENTION

Vacuum cleaners are generally supplied with a range of tools for dealing with specific types of cleaning. The tools include a floor tool for general on-the-floor cleaning. Efforts have been made to improve the pick up performance of floor tools on carpeted floors. Some tools have a brush mounted in the suction inlet which is rotated so as to agitate the floor surface in the same manner as the brush bar of an upright vacuum cleaner. The brush can be rotated by the use of an air turbine or by an electric motor which is powered by a power supply derived from the main body of the cleaner. However, this type of tool is typically more expensive than the passive floor tool and consumes power.

Efforts have also been made to improve floor tools in a more passive manner. For example, EP 1 320 317 discloses a floor tool having a suction channel bounded on at least one side by a working edge for engaging with and agitating the floor surface. Lint pickers on the underside of the tool act as a one-way gate, allowing hair, fluff and other fibrous material to pass under the lint picker when the floor tool is pushed along the floor, but to block the lint when the floor tool is pulled backwards. The repeated forward and backwards action of the floor tool across the floor surface traps the lint and rolls it into a ball such that it can be sucked by the floor tool. The floor tool also comprises a skirt of flexible bristles which surrounds, but is not part of, the underside of the floor tool. The skirt is movable between a deployed position, for use with cleaning hard floors, in which the skirt rides along the hard floor surface and serves to space the working edge from the floor surface, and a retracted position, for use when cleaning carpets, where the working edge is able to contact the floor surface and the skirt is retracted sufficiently not to impede movement of the floor tool across the carpeted surface.

It is known to provide a system for moving a bristle arrangement automatically between a retracted position and a deployed position depending on the nature of a floor surface to be cleaned. For example, GB 1,289,381 describes a floor tool having a pressure chamber delimited by a diaphragm fitted with bristles. The pressure chamber comprises springs which, when the pressure chamber is at atmospheric pressure, urge the diaphragm downwardly to move the bristles to the deployed position. The pressure chamber is connectable to an air flow passing through the floor tool, and thus a reduced pressure, by a valve located within the main body. The valve is connected by a push rod to a cup which has a lower surface arranged to face the floor surface.

When the floor tool is located on a hard floor surface, the lower surface of the cup is spaced from the floor surface by wheels located on the main body of the floor tool. The valve is maintained in a position in which the pressure chamber is isolated from the air flow passing through the floor tool, and so maintained at atmospheric pressure so that the springs urge the bristles to their deployed position. However, when the floor tool is located on a carpeted floor surface the wheels sink between the fibers of the floor surface so that the cup is brought into contact with the floor surface. The cup is pushed upwardly by the floor surface, which causes the valve to move to connect the pressure chamber to the air flow passing through the floor tool. The pressure within the pressure chamber is reduced, which causes the volume of the pressure chamber to decrease, against the biasing force of the springs, to move the bristles to their retracted position.

SUMMARY OF THE INVENTION

In a first aspect the present invention provides a surface treating head comprising a main body; a brush unit having an active state and an inactive state; and an actuating mechanism for actuating a transition of the brush unit between the inactive state and the active state comprising a housing moveable relative to the main body, and, disposed on the housing, an actuator moveable relative to the housing through engagement with a surface to be treated and at least one surface engaging member extending downwardly beyond the actuator.

The surface treating head of the present invention varies from the floor tool described in GB 1,289,381 insofar as the actuator and the surface engaging member are both disposed on a housing which is moveable relative to the housing. This can enable the surface engaging member and the actuator to move relative to the main body as the surface treating head is maneuvered over a floor surface, for example in response to undulations in the floor surface or over objects located on the floor surface, while maintaining a fixed spacing between the lower extremities of the surface engaging member and the actuator. This can reduce the likelihood of accidental actuation of the actuating mechanism as the surface treating head is maneuvered over a floor surface. The housing may be biased away from the main body, for example by a spring and/or under its own weight, to maintain the surface engaging member in contact with the floor surface.

The at least one surface engaging member preferably extends downwardly beyond the actuator by a distance in the range from 0.1 to 2 mm so that the movement of the actuator can be actuated upon the movement of the surface treating head from a hard floor surface to a shallow-piled carpet. The at least one surface engaging member preferably comprises at least one rolling element, which is preferably in the form of at least one wheel. In a preferred embodiment the surface treating head comprises a pair of wheels located on opposite sides of the actuator. The thickness of the wheels is preferably no greater than 10 mm so that the wheels can readily sink into the pile of a carpeted floor surface.

The brush unit is preferably moveable relative to the main body between its active and inactive state. For example, the brush unit preferably comprises at least one brush, which may comprise at least one of a row of bristles, a bristle curtain and at least one flexible strip of material, extending at least partially about the main body of the floor tool. In the inactive state of the brush unit, the brush is preferably located above a working edge of the main body, thereby placing the surface treating head in a configuration suitable for treating a carpeted floor surface. On the other hand, in the active state of the brush unit at least part of the brush is preferably located below the working edge of the main body. This places the surface treating head in a configuration suitable for treating a hard floor surface. Thus, the inactive state of the brush unit may correspond to the brush unit being located in a stowed position relative to the main body, whereas the active state of the brush unit may correspond to the brush unit being located in a deployed position relative to the main body.

Alternatively, the brush unit may be moveable relative to the main body in its active state, and stationary relative to the main body in its inactive state. For example the brush unit may comprise a rotatable agitator, in the form of a disc or brush bar having bristles or other surface agitating elements.

The actuating mechanism preferably uses air pressure to effect the transition of the brush unit between its active and inactive states. For example, the actuating mechanism may comprise a pressure chamber and a system for varying the air pressure within the chamber in response to movement of the actuator relative to the housing. The brush unit may then be switched between its active and inactive states depending on the air pressure within the chamber. The pressure chamber may have a volume which is variable depending on the difference between the air pressure within the chamber and the atmospheric air pressure external to the chamber, whereby a change in the volume of the pressure chamber causes the transition in the state of the brush unit.

At least part of the brush unit may extend over the upper surface of the main body, and may be arranged to move relative to, for example towards, the upper surface of the main body as the brush unit moves from a stowed position to a deployed position. For example, the brush unit may be in the form of a cover or a frame extending above and about the main body of the surface treating head.

The pressure chamber is preferably located between the main body and the brush unit. The pressure chamber is preferably located above the main body, and so may be located between the upper surface of the main body and a lower surface of part of the brush unit, and may be partially defined by the upper surface of the main body. The lower surface of the brush unit may also define part of the pressure chamber; alternatively a lower chamber section may be located on the upper surface of the main body, with the brush unit comprising an upper chamber section which is moveable relative to the lower chamber section. The chamber may further comprise an annular flexible sealing member extending between the upper and lower chamber sections to allow the volume of the pressure chamber to vary while providing an airtight seal therebetween. This sealing member may be in the form of a sleeve having one end connected to the upper chamber section and the other end connected to the lower chamber section.

Alternatively, one of the lower chamber section and the upper chamber section may be arranged in the form of a piston which is moveable relative to and within the other chamber section to vary the volume of the pressure chamber. In this case, an O-ring or other annular sealing element may be located on the peripheral surface of the innermost of the chamber sections to form an air tight seal between the chamber sections.

As a further alternative, the pressure chamber may be in the form of a bladder or other inflatable member located between the main body and the brush unit, and which moves the brush unit from the deployed position to the stowed position as it is inflated.

The chamber preferably houses a resilient member, such as a spring, for urging the chamber towards a configuration in which the brush unit is in a stowed position. Reducing the air pressure within the chamber can enable atmospheric pressure acting on the chamber, against the biasing force of the resilient member, to reduce the volume of the chamber, thereby moving the brush unit to a deployed position. Subsequently increasing the pressure within the chamber, for example by the admission of air at atmospheric pressure into the chamber, can enable the resilient element to increase the volume of the chamber, causing the brush unit to move to its stowed position to place the surface treating head in a configuration suitable for treating a carpeted floor surface.

The actuator is preferably configured to pivot relative to the housing, in use, through engagement with a surface to be treated when the surface treating head is maneuvered over that surface.

The means for varying the pressure with the chamber preferably comprises a valve, with the actuator being configured to operate the valve. The valve is preferably moveable relative to the housing, and so the housing preferably comprises means for converting movement of the actuator into movement of the valve relative to the housing. For example, the housing may comprise a cam rotatable by the actuator to effect movement of the valve relative to the housing. The valve is preferably biased towards the cam. The valve and the cam are preferably located within a valve chamber of the housing.

The main body preferably comprises a suction cavity forming part of a suction passage extending to an air outlet of the surface treating head, and the means for varying the air pressure within the chamber preferably comprises a fluid conduit extending between the suction passage and the chamber. The actuator and valve may be arranged to control the air flow through the fluid conduit. For example, the housing may comprise a fluid port exposed to the atmosphere and in fluid communication with the fluid conduit, and the valve may be configured to selectively close the fluid port. The valve is preferably moveable between a first position in which the fluid conduit is exposed to the atmosphere, and a second position in which the fluid conduit is substantially isolated from the atmosphere. The actuator is preferably biased towards a position in which the valve is in its second position.

The actuator preferably comprises two, angularly spaced rotated positions so that the actuator may oscillate rapidly between its two rotated positions as the surface treating head is moved back and forth over the carpeted floor surface so that the brush unit remains in its stowed position during both forward and backward strokes of the floor tool over the carpeted floor surface.

In a second aspect, the present invention provides a surface treating head comprising a main body; a brush unit; and a drive mechanism for moving the brush unit relative to the main body between a stowed position and a deployed position, the drive mechanism comprising a pressure chamber and a valve unit for varying the pressure within the chamber, the valve unit comprising a housing moveable relative to the main body, a valve located within the housing and, disposed on the housing, an actuator moveable relative to the housing through engagement with a surface to be treated for operating the valve and at least one surface engaging member extending downwardly beyond the actuator.

In a third aspect, the present invention provides a surface treating head comprising a main body; a suction passage extending between a suction opening and an air outlet; a brush unit having an active state and an inactive state; and an actuating mechanism for actuating a transition of the brush unit between the inactive state and the active state, the actuating mechanism comprising a pressure chamber, a fluid conduit extending from the pressure chamber for connecting the pressure chamber to the suction passage, and a control mechanism for controlling the air flow through the fluid conduit, the control mechanism comprising a fluid port exposed to the atmosphere and in fluid communication with the fluid conduit, a valve for selectively closing the fluid port, and a valve actuator for operating the valve.

Features described above in relation to the first aspect of the invention are equally applicable to any of the second to third aspects of the invention, and vice versa.

The present invention also provides a surface treating appliance, for example a vacuum cleaner, comprising a surface treating head as aforementioned.

BRIEF DESCRIPTION OF THE DRAWINGS

The invention will now be described, by way of example, with reference to the accompanying drawings, in which.

DETAILED DESCRIPTION OF THE INVENTION

Figure 1:
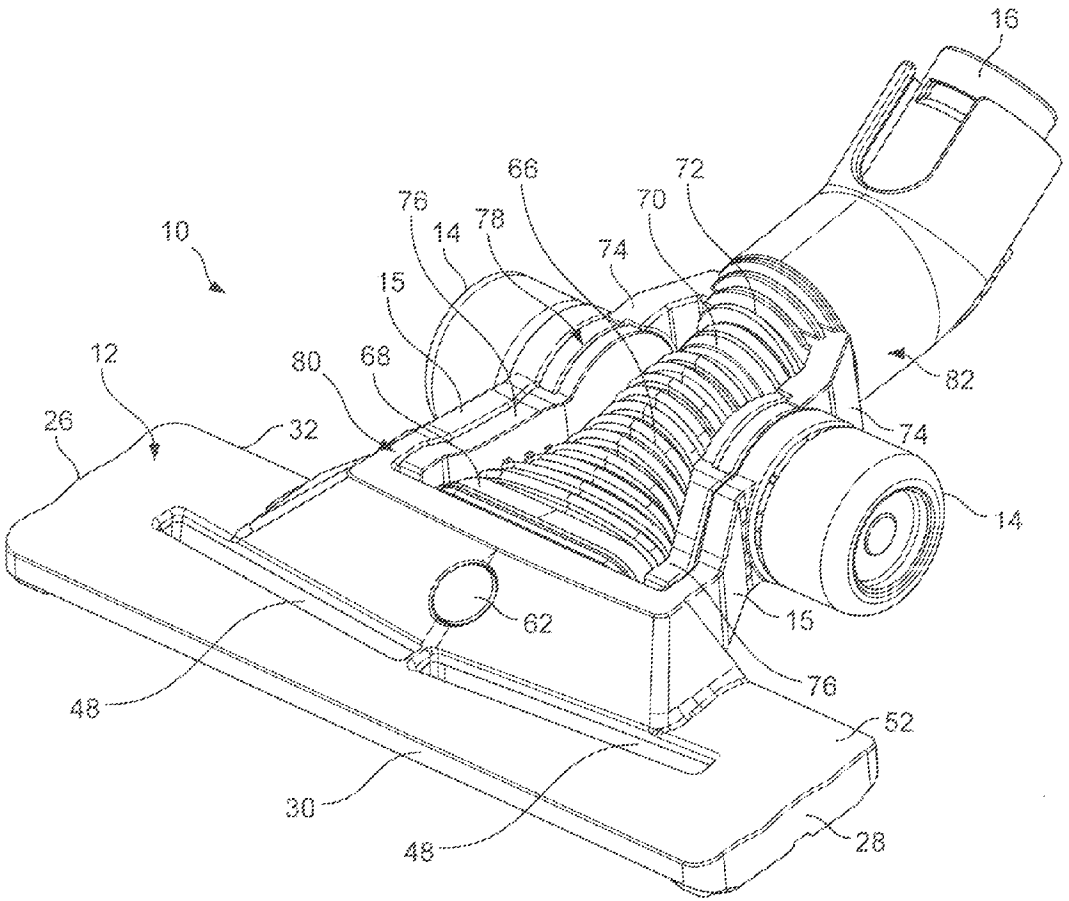
FIG. 1 is a top perspective view of a first surface treating head.

FIGS. 1 to 4 and 6 illustrate a first surface-treating head in the form of a vacuum cleaner floor tool 10. The floor tool 10 comprises a main body 12 and a pair of wheels 14 arranged to allow the floor tool 10 to be maneuvered over a floor surface. Each wheel 14 is rotatably connected to a respective arm 15 extending rearwardly from the main body 12. The floor tool 10 further comprises a connector 16 having an open end which is connectable to a wand or hose of a vacuum cleaner. The bottom surface 18 of the floor tool 10, which may be integral with the main body 12, delimits a suction cavity 20 of the floor tool 10. In use, the suction cavity 20 faces the floor surface to be cleaned and admits dirt-bearing air from the floor surface into the floor tool 10. A pair of wheels 21 is rotatably mounted within recesses formed in the bottom surface 18 of the main body 12 to space the bottom surface 18 of the floor tool 10 from, for example, a hard floor surface over which the floor tool 10 is being maneuvered.

The suction cavity 20 comprises a first suction channel 22 and a second suction channel 24, which both extend between opposite side edges 26, 28 of the main body 12 of the floor tool 10. The first suction channel 22 is located towards the front wall 30 of the floor tool 10, with the second suction channel 24 situated towards the rear wall 32 of the floor tool 10. The first and second suction channels 22, 24 have substantially similar external dimensions and are located in the same plane. The second suction channel 24 opens into an outlet 34 located centrally in the rear wall 32 of the main body 12. Intermediate channels 36 provide a fluid connection between the first suction channel 22 and the second suction channel 24. Two intermediate channels 36 are provided, each one located towards a respective side edge 26, 28 of the main body 12. The intermediate channels 36 extend transversely between the suction channels 22, 24. The outside walls of the intermediate channels 36 comprise part of the side edges 26, 28 of the floor tool 10.

Each of the suction channels 22, 24 is bounded by working edges formed by the bottom surface 18 of the floor tool 10. The first suction channel 22 has a front working edge 40 and a rear working edge 42. The second suction channel 24 also has a front working edge 44 and a rear working edge 46. The working edges are sharply defined so as to provide an effective agitating action when the floor tool 10 is used on carpeted surfaces. On such a surface, the wheels 21 sink into the pile of the carpet to bring the working edges into contact with the carpet.

The floor tool 10 further comprises at least one air duct. In this example, the at least one air duct is in the form of two slots 48, each of which is delimited by the rear working edge 42 of the first suction channel 22, the inside wall of an intermediate channel 36 and the front working edge 44 of the rear suction channel 24. Each slot 48 extends from an upper surface 52 of the floor tool 10 down to the bottom surface 18 of the floor tool 10. Each slot 48 is open to atmosphere.

Figure 5A:
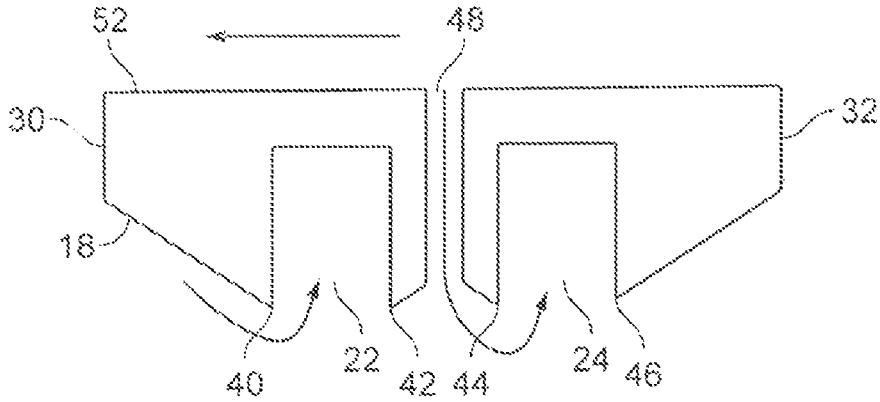
FIG. 5*a* is a schematic side view of part of the head of FIG. 1 in use in a first direction.
Figure 5B:
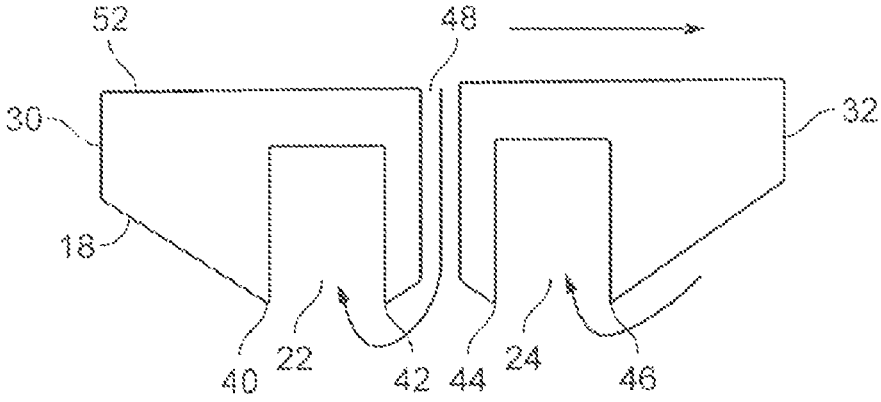
FIG. 5*b* is a schematic side view of the part of FIG. 5*a* in use in a second direction.

FIGS. 5*a* and 5*b* illustrate schematically the function of the air slots 48 and the working edges in use. In FIG. 5*a*, the floor tool 10 is being pushed forwardly along a carpeted floor surface, which direction is represented by the large arrow over the upper surface 52. The floor tool 10 is in fluid communication with a vacuum cleaner which generates a suction airflow, as will be discussed later. On the forward stroke of the floor tool 10, the front working edges 40, 44 of the respective suction channels 22, 24 come into operation. The front working edges 40, 44 open out the pile of the carpet so that suction air can flow about the front working edges 40, 44 and into the suction channels 22, 24, as shown by the smaller arrows. Air is drawn under the front wall 30 of the main body 12, under the front working edge 40 and into the first suction channel 22 of the suction cavity 20. Air from the first suction channel 22 flows through the intermediate channels 36 into the second suction channel 24, and exits the suction cavity 20 through the outlet 34. Air is also drawn in through the air slots 48 from the atmosphere, under the front working edge 44 and into the second suction channel 24 of the suction cavity 20. Air from the second suction channel 24 exits the suction cavity 20 through the outlet 34. The outlet 34 has a flared opening in order to provide a smooth transition between the second suction channel 24 and the outlet 34.

In FIG. 5*b*, the floor tool 10 is being drawn back along the carpeted floor surface, which direction is represented by the large arrow over the upper surface 52. On the backward stroke of the floor tool 10, the rear working edges 42, 46 of the suction channels 22, 24 come into operation. Air is drawn in through the air slots 48 from the atmosphere, under the rear working edge 42 and into the first suction channel 22. Air from the first suction channel 22 flows through the intermediate channels 36 into the second suction channel 24, and exits the suction cavity 20 through the outlet 34. Air is also drawn under the rear wall 32 of the main body 12, under the rear working edge 46 and into the second suction channel 24. Air from the second suction channel 24 exits the suction cavity 20 through the outlet 34.

Thus, for each stroke of the floor tool 10, a plurality of working edges comes into effect, such that pick-up of dirt and dust is improved in comparison with conventional floor tools having one suction channel and two working edges only. By providing a fluid connection between the first and second channels 22, 24 that extends along the side walls 26, 28 of the floor tool 10, a floor tool having multiple suction channels and working edges can be manufactured having similar dimensions to a conventional, single suction channel floor tool. In particular, the depth of the floor tool 10 can be made to be relatively small so that the floor tool 10 has a low profile. This benefit is most noticeable in FIGS. 3 and 4.

Figure 2:
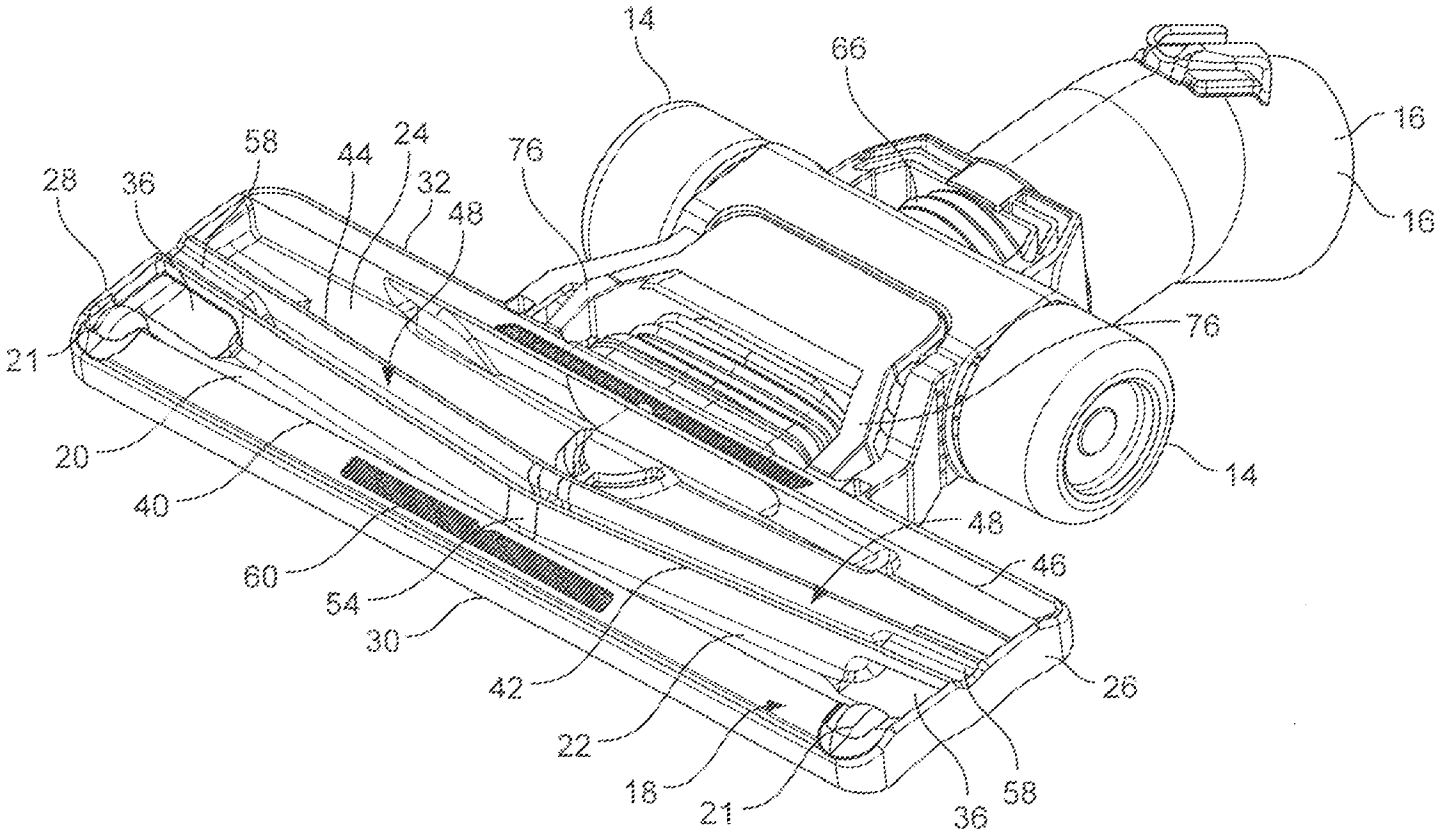
FIG. 2 is a bottom perspective view of the head of FIG. 1.
Figure 3:
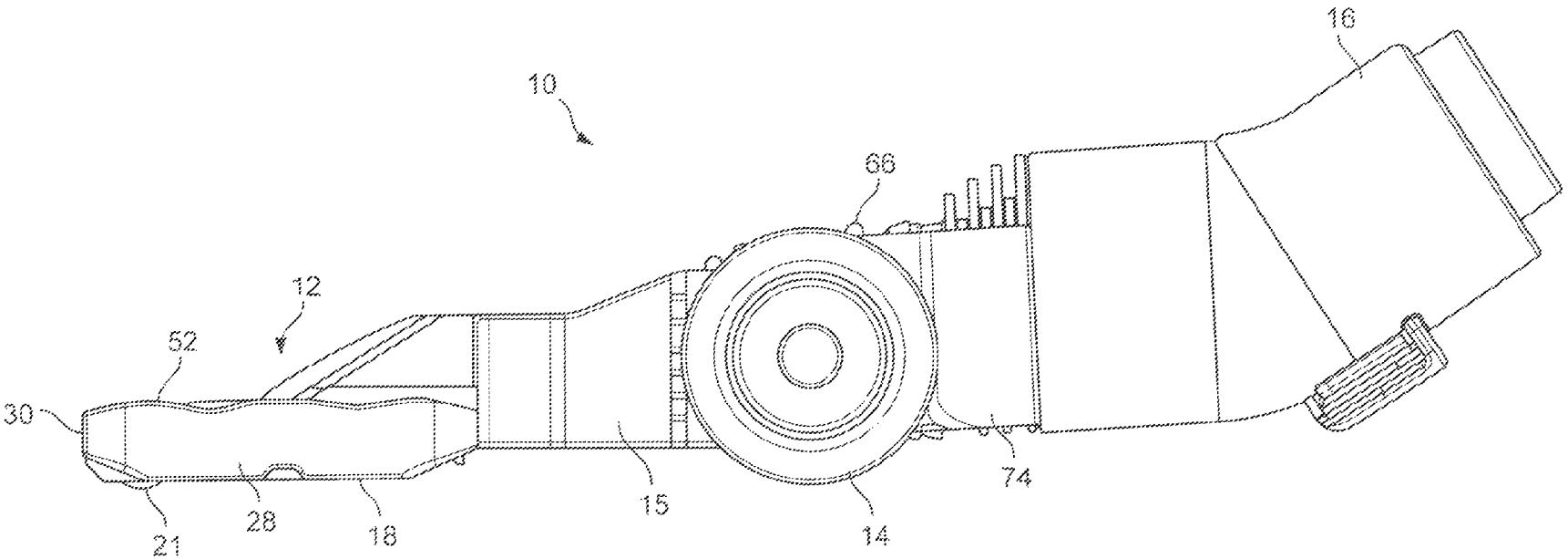
FIG. 3 is a side view of the head of FIG. 1.
Figure 4:
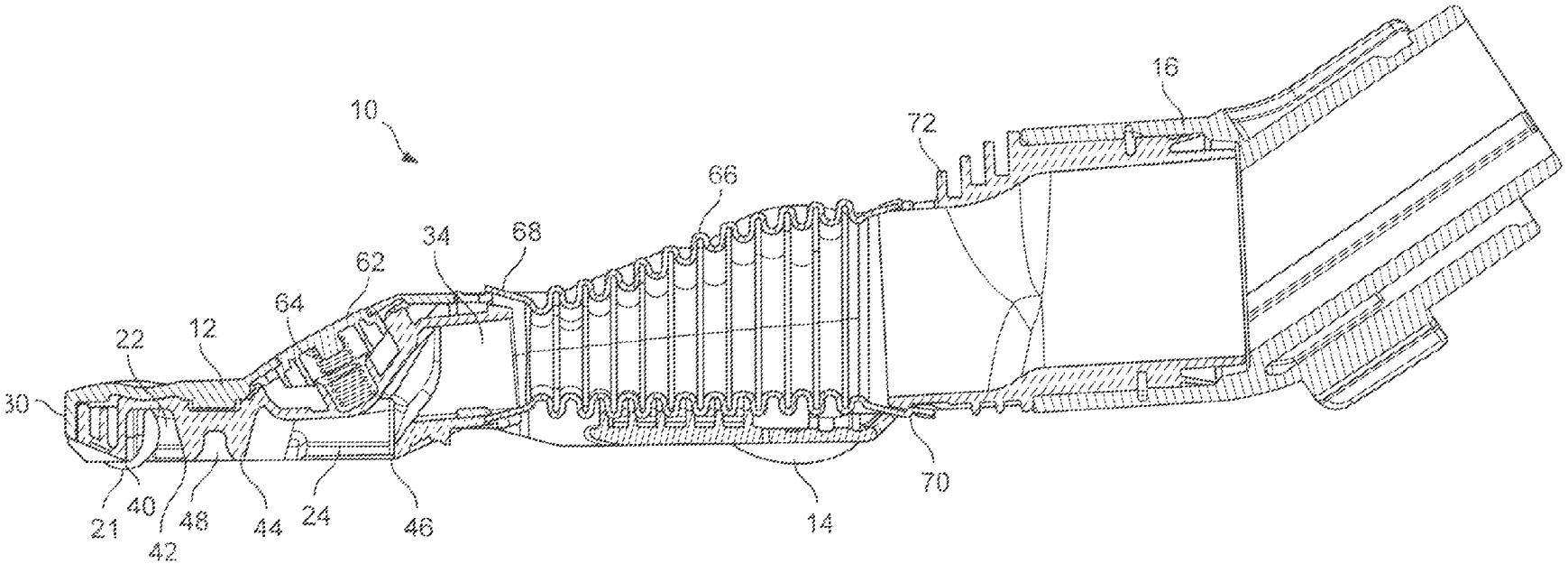
FIG. 4 is a sectional side view of the head of FIG. 1.
Figure 6:
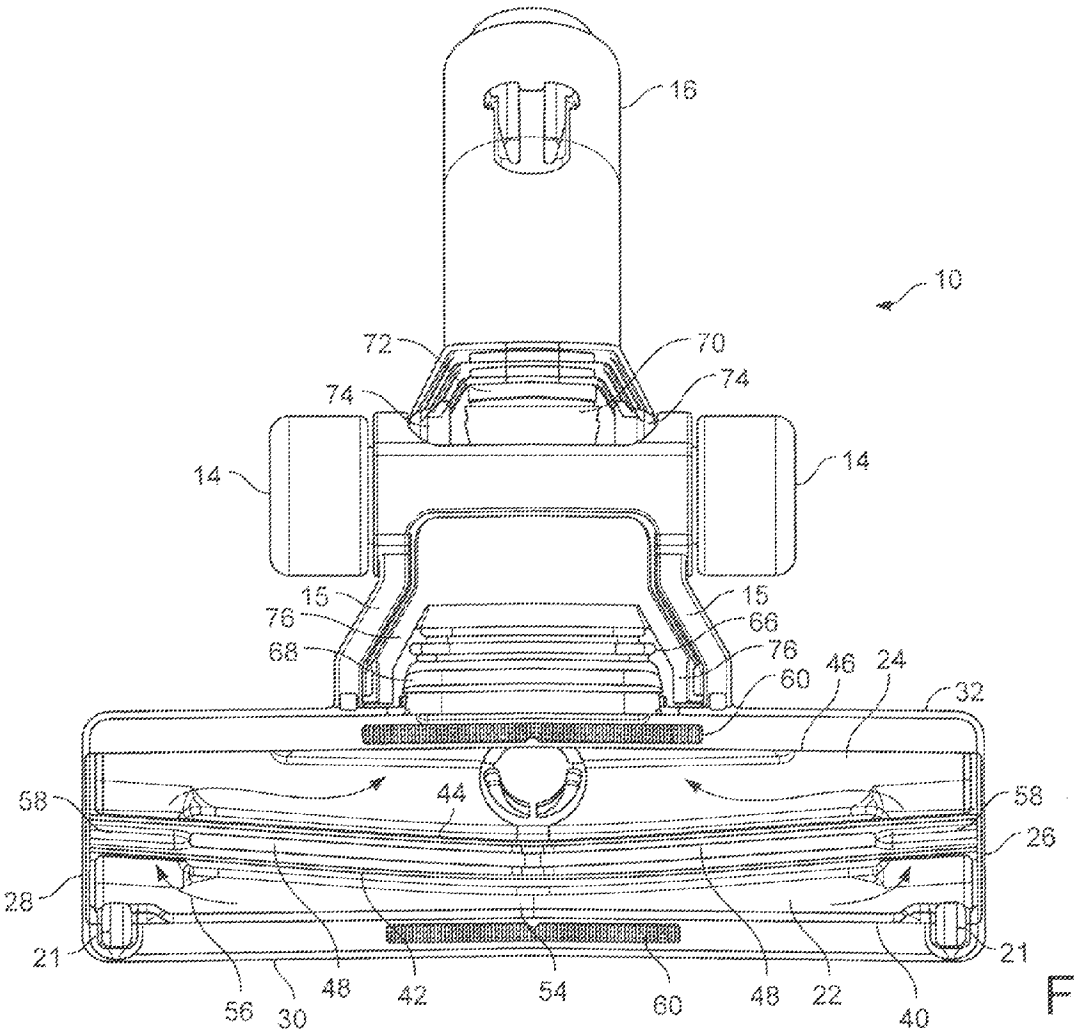
FIG. 6 is a bottom view of the head of FIG. 1.

Details of the suction cavity 20 are visible in FIGS. 2 and 6, which illustrate in more detail the underside of part of the floor tool 10. The suction cavity 20 does not have a uniform cross section. The first suction channel 22 has a central region 54 which has the smallest cross-sectional area of the suction cavity 20. The cross-sectional area increases along the portion of the fluid flow path 56 (indicated in FIG. 6) that extends from the central region 54 along the rest of the first suction channel 22 to its outer edges adjacent the side walls 26, 28 of the floor tool 10. The cross-sectional area of the suction cavity 20 is substantially constant along the portion of the fluid flow path 56 that extends from the first suction channel 22 along the intermediate channels 36 to the second suction channel 24. The cross-sectional area of the suction cavity 20 increases further along the portion of the fluid flow path 56 that extends from the intermediate channels 36 along the second suction channel 24 to the outlet 34 located in a central portion of the rear wall 32 of the main body 12. In order to accommodate this shape of the suction cavity 20, the air slots 48 are arranged to be, in combination, chevron-shaped, with an apex adjacent the central region 54 of the first suction channel 22. By arranging for the suction cavity 20 to have an increasing cross-section along at least part of the fluid flow path 56, a substantially constant fluid pressure is maintained throughout the suction cavity 20. This provides a further benefit in performance, as it ensures that air is drawn evenly into both suction channels 22, 24 across the full width of the suction channels 22, 24.

The front working edge 40 and the rear working edge 46 extend across the width of the main body 12 of the floor tool 10. In order to further increase the effect of the working edges 42, 44 that are adjacent the air slots 48, these edges are extended to the side wall 26, 28 by way of bridges 58 that traverse the intermediate channels 36. The bridges 58 extend from opposite edges of the air slots 48 to the side walls 26, 28 and also provide small passageways for fluid to flow from the side walls under and along the portions of the working edges 42, 44 formed by the bridges 58. The bridges 58 may form an integral part of the bottom surface 18 of the floor tool 10. By providing working edges that extend substantially the full width of the floor tool 10, a greater agitation effect can be achieved.

Lint pickers 60 are provided on the bottom surface 18 of the floor tool 10 at the front and rear portions of the floor tool 10, spaced from the working edges 40, 46. Each of the lint pickers 60 comprises a strip of material in which a plurality of tufts of fine fiber is secured. The repeated forward and backwards action of the floor tool 10 across the floor surface traps hair, fluff and other fibrous material and rolls it into a ball such that it can be sucked into the suction cavity 20. The use of lint pickers 60 causes an increase in the force that a user requires to push or pull the floor tool 10 across a floor surface. It would be possible to increase the width of the lint pickers 60 to substantially the total width of the floor tool although this would incur an increase in the push force required by a user.

A bleed valve 62 is provided in the upper surface 52 of the floor tool 10. In the event that the suction cavity 20 becomes blocked by, for example, fabric being drawn into the suction channels 22, 24, the pressure inside the suction cavity 20 will drop. When the pressure inside the suction cavity 20 falls below a predetermined value, atmospheric pressure acts on the bleed valve 62 and urges it inwardly against the force of a spring 64, thus providing an opening for atmospheric air to enter the floor tool 10. When the blockage is removed, the force of the spring 22 urges the bleed valve 62 back into its original position, flush with the upper surface 52.

In order to obtain the best possible performance from the floor tool 10, it is important that the working edges remain in contact with the floor as the floor tool 10 is pulled and pushed along a floor surface. In order to achieve this, articulation is provided between the outlet 34 and the connector 16 that connects with a wand or hose of a vacuum cleaner. Articulation is provided in the form of a flexible internal hose 66. One end portion 68 of the internal hose 66 has a wide mouth that fits over and seals against the slot-shaped outlet 34 of the suction cavity 20. The other end portion 70 of the internal hose 66 has a circular cross-section and is arranged to fit over and seal against a neck 72 that, in turns, fits inside the connector 16. The neck 72 is connected to, preferably integral with, a second pair of arms 74 which extend towards the main body 12 of the floor tool 10. Each arm 74 is pivotably connected towards one end thereof to a first end of a respective one of a third pair of arms 76. This provides a first articulated joint 78 of the floor tool 10. The second end of each of the arms 76 is pivotably connected to a respective arm 15 of the main body 12 of the floor tool 10. This provides a second articulated joint 80 of the floor tool 10. The first and second joints 78, 80 pivot about axes that are parallel with the floor surface. The internal hose 66 provides a reliable seal of the airway between the outlet 34 and the connector 16 while allowing movement and flexibility.

The connector 16 is arranged to rotate with respect to the neck 72 about an axis that is orthogonal to the axes of the first and second joints 78, 80. The rotatable connection of the neck 74 with the connector 16 forms a third joint 82, which allows the tool to move laterally. In use, the three joints allow the floor tool 10 to be manipulated and steered while maintaining contact of the working edges with the carpet, so that the pick-up performance of the tool is increased. The double articulation arrangement of the first and second joints 78, 80 allows forces applied to the floor tool 10 by the user to be transmitted through the wheels 14 of the floor tool 10. This helps to reduce motion resistance and also allows the user to complete a longer stroke while keeping the floor tool 10 flat to the floor surface.

Figure 7A:
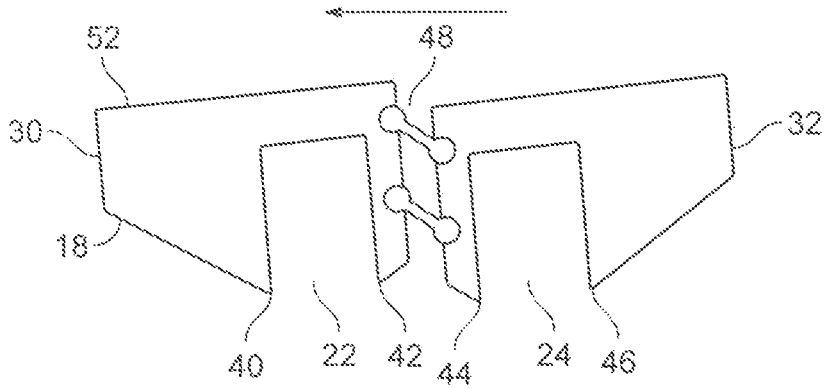
FIG. 7*a* is a schematic side view of an alternative to the part shown in FIG. 5*a*, in use in a first direction.
Figure 7B:
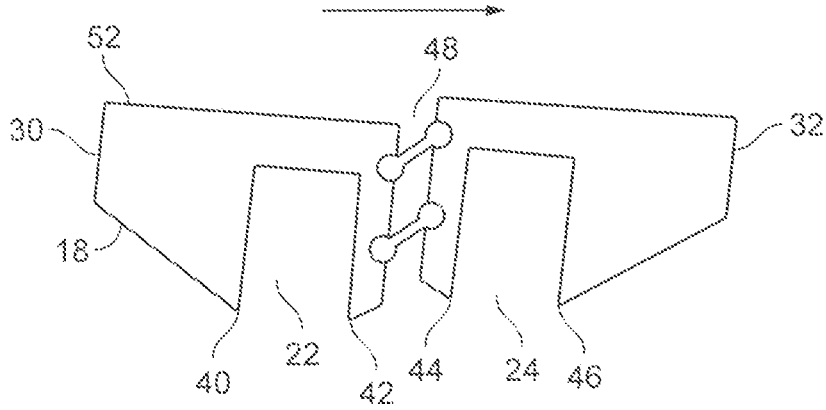
FIG. 7*b* is a schematic side view of the part of FIG. 7*a* in use in a second direction.

FIGS. 7*a* and 7*b* illustrate an articulated alternative to the parts shown in FIGS. 5*a* and 5*b*. In this alternative, the first and second suction channels 22, 24 are articulated with respect to each other. Flexible joints 84 connect the first suction channel 22 to the second suction channel 24. In FIG. 7*a*, the floor tool 10 is being pushed forwardly along a carpeted floor surface, which direction is represented by the large arrow over the upper surface 52. On the forward stroke of the floor tool 10, the flexible joints 84 allow the first and second suction channels 22, 24 to pivot forwardly, lowering the working edges 40, 44 so that they are brought into engagement with the floor surface. On the reverse stroke, as shown in FIG. 7*b*, the flexible joints 84 allow the first and second suction channels 22, 24 to pivot rearwardly, lowering the working edges 42, 46 towards the floor surface. This embodiment keeps the working edges in engagement with the floor surface in a variety of working positions of the floor tool 10 even if the connection between the outlet 34 and the connector 16 is rigid.

Figure 8:
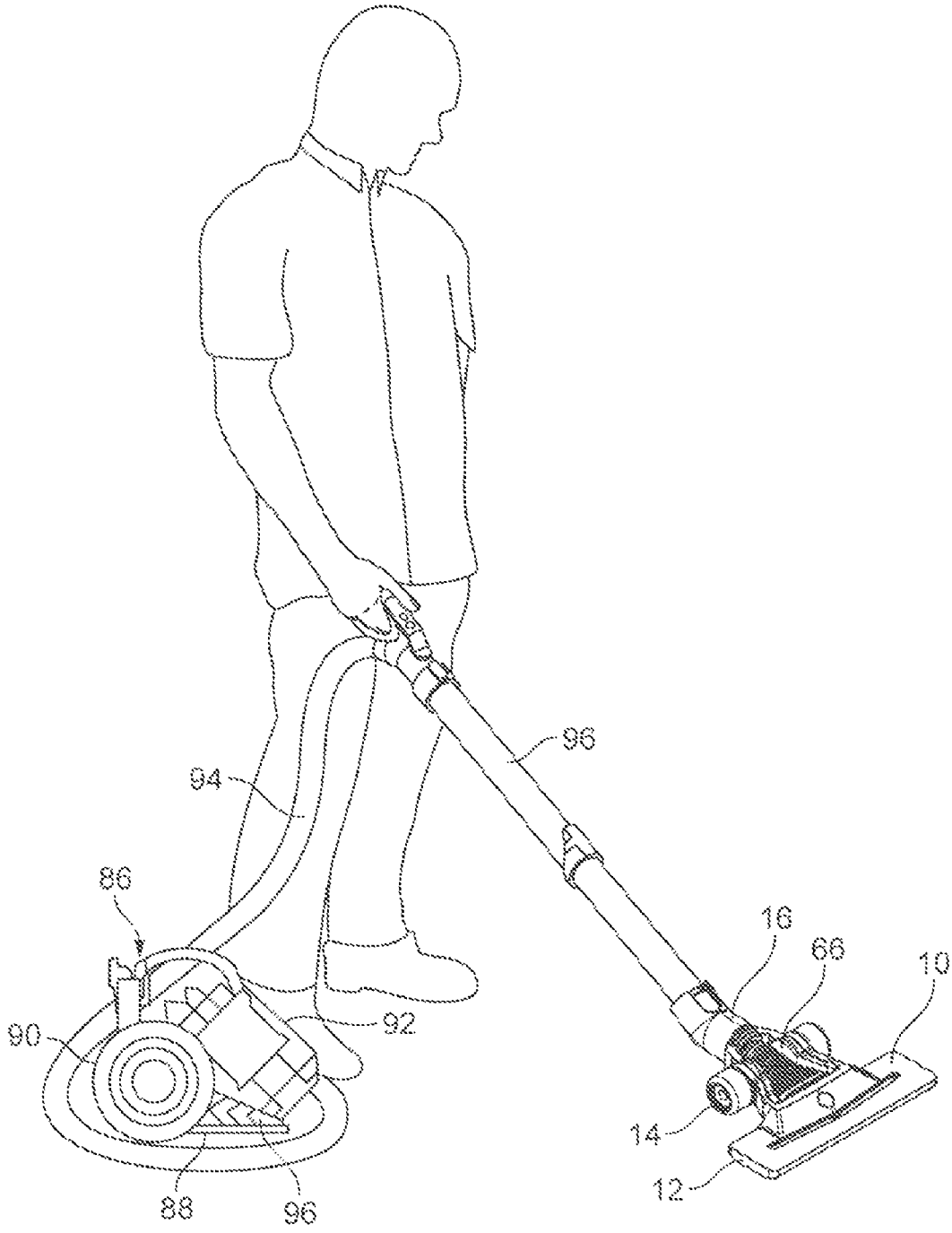
FIG. 8 is a side view of a vacuum cleaner incorporating the head of FIG. 1 in use.
Figure 9:
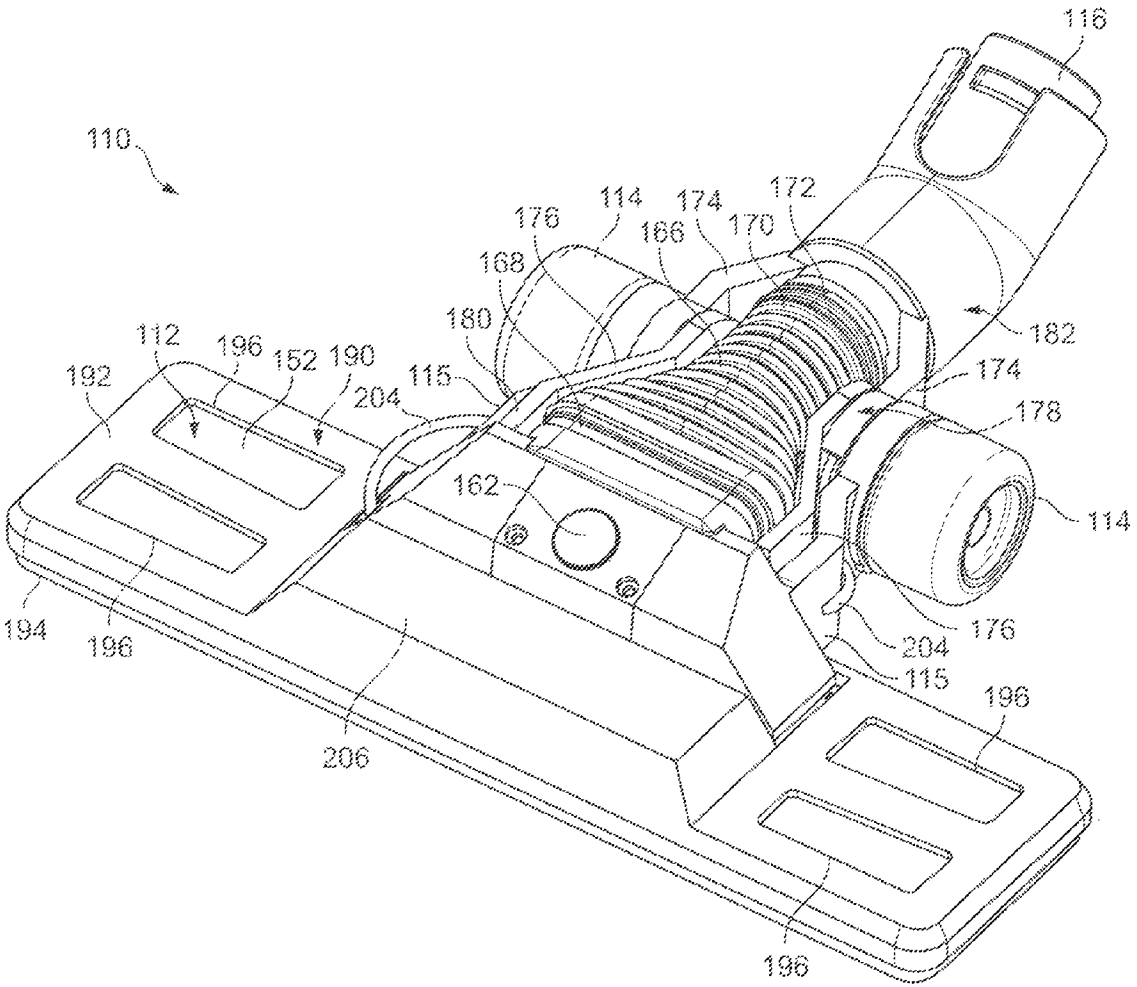
FIG. 9 is a top perspective view of a second surface treating head.

FIG. 8 shows the floor tool 10 as part of a surface-treating appliance in the form of a cyclonic vacuum cleaner 86. The vacuum cleaner 86 has a main body 88 housing a motor and fan unit (not shown). The main body 88 includes means for allowing the vacuum cleaner 86 travel across a floor surface, which, in this embodiment, comprises a pair of wheels 90. Separating apparatus in the form of a cyclonic separator 92 is releasably attached to the main body 88. A flexible hose 94 is connectable to an inlet port on the main body 88. The other end of the flexible hose 94 is connectable to a wand 96, the distal end of which is adapted to receive the connector 16 of the floor tool 10. The connector 16 could also be connected directly to the hose 94. During use, the main body 88 of the vacuum cleaner 86 is pulled along the floor surface by the flexible hose 94 as a user moves around a room. When the user switches on the vacuum cleaner 86, the motor is energized and drives a fan so as to draw in dirty air through the floor tool 10. The dirty air, carrying dirt and dust from the floor surface, is drawn through the wand 96 and hose 94 and into the cyclonic separator 92 via the inlet port.

The cyclonic separator 92 includes an upstream cyclone followed by a plurality of downstream cyclones. Air entering the cyclonic separator 92 is encouraged to follow a helical path around the interior of the cyclones. Dirt and dust becomes separated from the swirling flow of air. The cleaned air then passes from the cyclonic separator 92 into the main body 88 of the vacuum cleaner 86. The cleaned air then travels sequentially through a pre-motor filter, the motor and fan unit and then a post-motor filter before exiting the vacuum cleaner 86 through an exhaust 98.

The low profile of the floor tool 10 allows it to be employed under low furniture and other obstacles. Manufacture of such a low profile tool is possible due to the provision of a fluid flow path 56 that extends from the first suction channel 22 to the second suction channel 24 and from there to the outlet 34. The working edges and the air slots 48 together produce an effective agitating action, which is beneficial in dislodging dirt and dust from the pile of carpets. The agitating action may be at least as good as that achievable by a driven brush bar.

The appliance need not be a cyclonic vacuum cleaner. The invention is applicable to other types of surface treating head for vacuum cleaners, for example heads and tools of upright machines, stick-vacuums or hand-held cleaners. Further, the present invention is applicable to other types of cleaning head, for example, the head of a wet and dry machine or a carpet shampooer, and surface-treating heads in general—such as those employed in polishing/waxing machines, pressure washing machines, ground marking machines and lawn mowers.

The invention has been described with reference to a passive tool but is equally suitable in connection with a tool employing an agitator, such as a brush bar or beater, driven by a motor or turbine.

Further suction channels may be provided, each of which is bounded by at least one, and preferably two working edges. Each extra suction channel may be separated from its neighbour by further atmospheric air ducts. The (or each) atmospheric air may comprise a single opening or a plurality of smaller slots, nozzles or ducts. The provision of atmospheric air passageways of relatively small dimensions may help to form high-pressure jets of air close to the working edges to further dislodge debris from the carpet. By providing several atmospheric air ducts instead of a single uninterrupted duct, the robustness of the floor tool may be improved.

Further variations will be apparent to the person skilled in the art. For example, at least one of the lint pickers may be omitted or replaced by strips of felt, rows of bristles or combs.

FIGS. 9 to 12 illustrate a second surface treating head in which a brush is arranged to be selectively lowered and raised with respect to the main body. This second surface-treating head is also in the form of a vacuum cleaner floor tool 110. The floor tool 110 comprises a main body 112 and a pair of wheels 114 arranged to allow the floor tool 110 to be maneuvered over a floor surface. Each wheel 114 is rotatably connected to a respective arm 115 extending rearwardly from the main body 112. The floor tool 110 further comprises a connector 116 having an open end which is connectable to a wand or hose of a vacuum cleaner. The bottom surface 118 of the floor tool 110 delimits a suction cavity 120 of the floor tool 110. In use, the suction cavity 120 faces the floor surface to be cleaned and admits dirt-bearing air from the floor surface into the floor tool 110. In this floor tool 110, a single wheel 121 is rotatably mounted within a recess formed towards the front edge 130 of the bottom surface 118 of the main body 112 to space the bottom surface 118 of the floor tool 110 from, for example, a hard floor surface over which the floor tool 110 is being maneuvered.

Similar to the suction cavity 20 of the floor tool 10, the suction cavity 120 comprises a first suction channel 122 and a second suction channel 124, which both extend between opposite side edges 126, 128 of the main body 112 of the floor tool 110. The first suction channel 122 is located towards the front wall 130 of the main body 112, with the second suction channel 124 situated towards the rear wall 132 of the main body 112. The first and second suction channels 122, 124 have substantially the same shape as the first and second suction channels 22, 24 of the floor tool 10. The second suction channel 124 opens into an outlet 134 located centrally in the rear wall 132 of the main body 112. Intermediate channels 136 provide a fluid connection between the first suction channel 122 and the second suction channel 124. As with the floor tool 10, two intermediate channels 136 are provided, each one located towards a respective side edge 126, 128 of the main body 112. The intermediate channels 136 extend transversely between the suction channels 122, 124. The outside walls of the intermediate channels 136 comprise part of the side edges 126, 128 of the main body 112.

Similar to the floor tool 10, each of the suction channels 122, 24 is bounded by working edges formed by the bottom surface 118 of the main body 112. The first suction channel 122 has a front working edge 140 and a rear working edge 142. The second suction channel 124 also has a front working edge 144 and a rear working edge 146. The shape and purpose of the working edges of the floor tool 110 is substantially the same as those of the working edges of the floor tool 10.

The floor tool 110 further comprises at least one air duct. In this example, the at least one air duct is in the form of two slots 148, each of which is delimited by the rear working edge 142 of the first suction channel 122, the inside wall of an intermediate channel 136 and the front working edge 144 of the rear suction channel 124. Each slot 148 extends from an upper surface 152 of the main body 112 down to the bottom surface 118 of the main body 112. Each slot 148 is open to atmosphere, and so has the same function as the slots 48 of the floor tool 10.

Lint pickers 160 are also provided at the front and rear portions of the bottom surface 118 of the main body 112. As with the floor tool 10, a bleed valve 162 is provided in the upper surface 152 of the main body 112 of the floor tool 110. The bleed valve 162 functions in a similar manner to the bleed valve 62 of the floor tool 10.

The floor tool 110 is articulated in a similar manner to the floor tool 10. The floor tool 110 comprises a flexible internal hose 166. One end portion 168 of the internal hose 166 has a wide mouth that fits over and seals against the outlet 134 of the suction cavity 120. The other end portion 170 of the internal hose 166 has a circular cross-section and is arranged to fit over and seal against a neck 172 that, in turns, fits inside the connector 116. The neck 172 is connected to, preferably integral with, a second pair of arms 174 which extend towards the main body 112 of the floor tool 110. Each arm 174 is pivotably connected towards one end thereof to a first end of a respective one of a third pair of arms 176. This provides a first articulated joint 178 of the floor tool 110. The second end of each of the arms 176 is pivotably connected to a respective arm 115 of the main body 112. This provides a second articulated joint 180 of the floor tool 110. The first and second joints 178, 180 pivot about axes that are parallel with the floor surface. The connector 116 is arranged to rotate with respect to the neck 172 about an axis that is orthogonal to the axes of the first and second joints 178, 180. The rotatable connection of the neck 174 with the connector 116 forms a third joint 182, which allows the tool to move laterally.

In contrast to the floor tool 10, the floor tool 110 comprises a brush unit 190. The brush unit 190 comprises a cover 192 extending over and about the main body 112 of the floor tool. The lower surface of the cover 192 comprises an annular groove within which a row or curtain of bristles 194 is located so that the bristles 194 extend about the main body 112 of the floor tool 110. A series of castellations (not shown) may be formed in the portion of the row of bristles 194 adjacent the front edge 130 of the main body 112. The cover 192 comprises a plurality of windows 196 to allow air to pass over the upper surface 152 of the main body 122 to the slots 148. Part of the cover 192 is located directly above the slots 148.

The floor tool 110 comprises a drive mechanism 200 for moving the brush unit 190 between a stowed position and a deployed position. As described in more detail below, in the stowed position of the brush unit 190 the bristles 194 are located above the working edges 140, 142, 144, 146 of the main body 112, whereas in the deployed position of the brush unit 190 at least the tips of the bristles 194 are located below the working edges 140, 142, 144, 146 of the main body 112. Consequently, the floor tool 110 can be switched between a first configuration in which the floor tool 110 is suitable for cleaning a carpeted floor surface, and a second configuration in which the floor tool 110 is suitable for cleaning a hard floor surface.

Figure 14A:
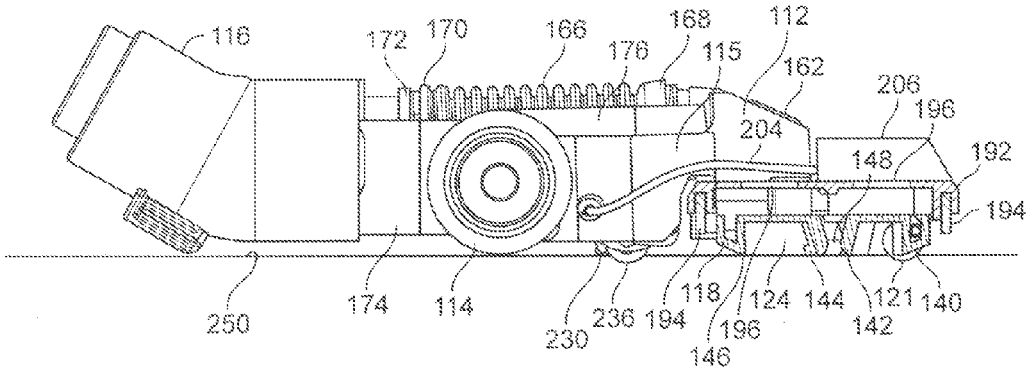
FIG. 14*a* is a side sectional view along line A-A in FIG. 12 with the brush unit of the head in a stowed position.
Figure 14B:
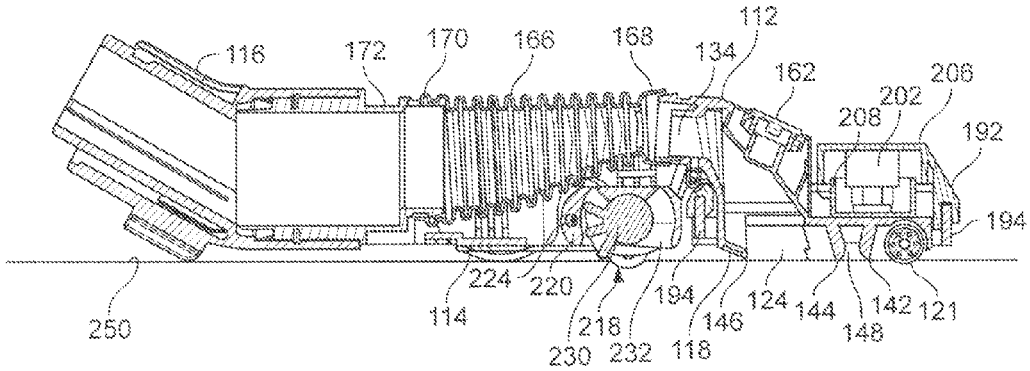
FIG. 14*b* is a side sectional view along line B-B in FIG. 12 with the brush unit of the head in a stowed position.
Figure 14C:
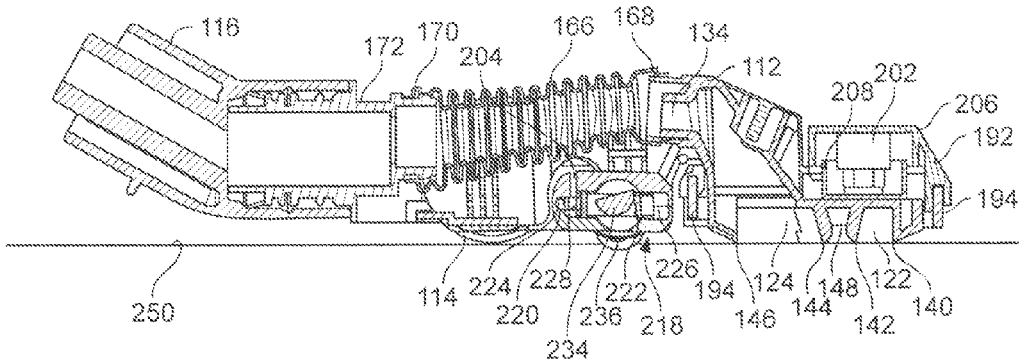
FIG. 14*c* is a side sectional view along line C-C in FIG. 12 with the brush unit of the head in a stowed position.
Figure 15A:
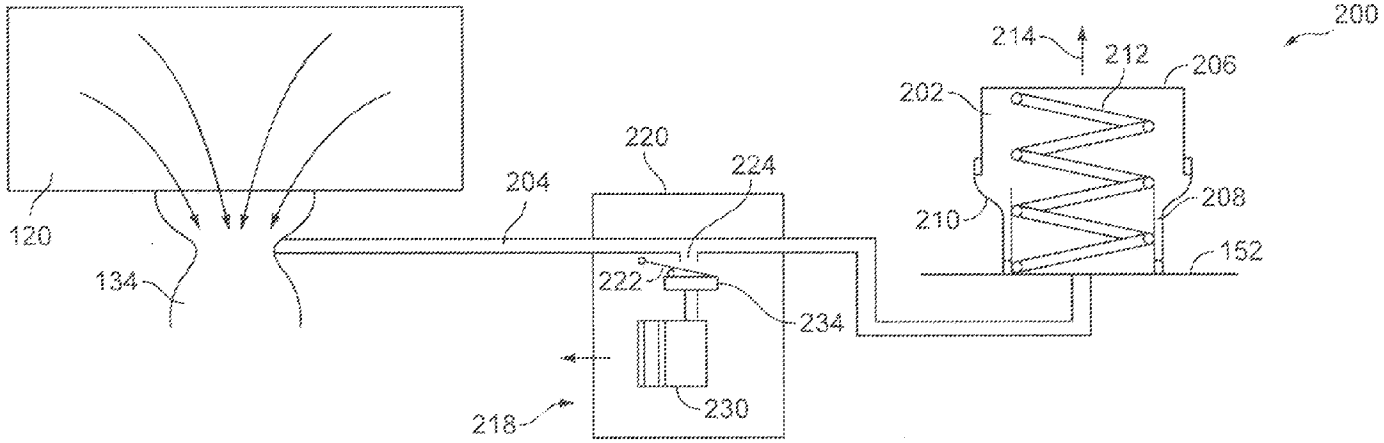
FIG. 15*a* is a schematic illustration of a drive mechanism for moving the brush unit of the head of FIG. 9, with the mechanism in a configuration in which the brush unit is in its stowed position.
Figure 15B:
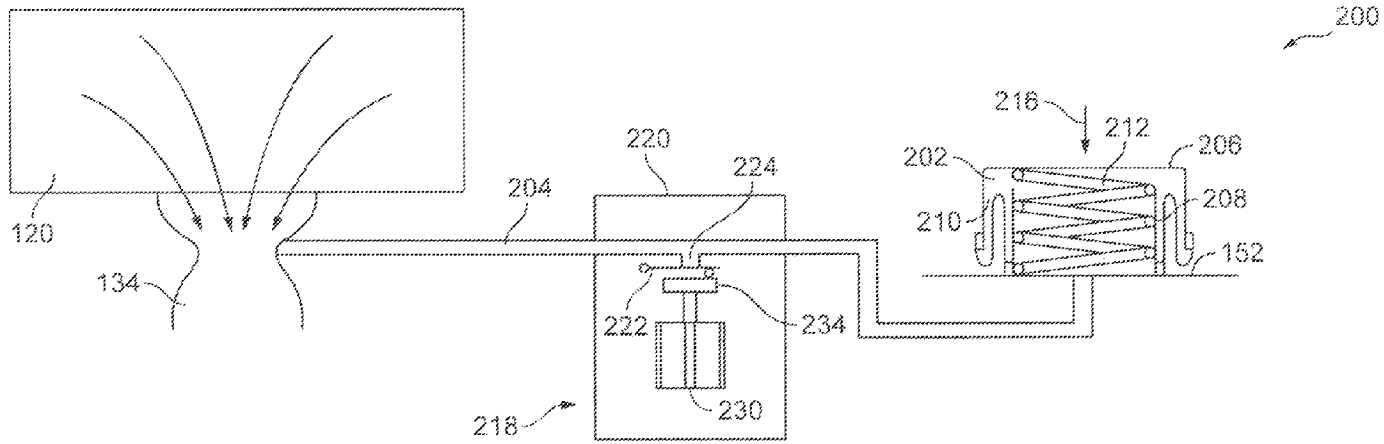
FIG. 15*b* is a similar illustration to FIG. 15*a*, with the drive mechanism in a configuration in which the brush unit is in its deployed configuration.

The drive mechanism 200 is illustrated schematically in FIGS. 15*a* and 15*b*. Various components of the drive mechanism 200 are also visible in FIGS. 9 to 14. The drive mechanism 200 uses air pressure to effect the movement of the brush unit 190 between its stowed and deployed positions. The drive mechanism 200 comprises a pressure chamber 202 which is placed in fluid communication with the outlet 134 from the suction cavity 120 by a fluid conduit 204 extending therebetween. The fluid conduit 204 may be formed from a plurality of connected pipes or tubes. The pressure chamber 202 comprises an upper chamber section 206 defined by a raised central portion of the cover 192 of the brush unit 190. The pressure chamber 202 also comprises a lower chamber section 208 attached to the upper surface 152 of the main body 112. A flexible, annular sealing member 210, which is preferably in the form of a sleeve, is connected to both the upper chamber section 206 and the lower chamber section 208 to form an airtight seal therebetween, and to allow the upper chamber section 206 to move relative to the lower chamber section 208.

The pressure chamber 202 houses a resilient member 212, preferably in the form of a helical spring, for urging the upper chamber section 206 away from the lower chamber section 208. The biasing force of the resilient member 212 is selected so that the pressure chamber 202 has a volume which is variable depending on the difference between the air pressure within the pressure chamber 202 and the atmospheric air pressure external to the pressure chamber 202. When this pressure difference is relatively low, the upper chamber section 206 is urged away from the lower chamber section 208, as indicated by arrow 214 in FIG. 15*a*, by the resilient member 212 so that the pressure chamber 202 adopts an expanded configuration. In this configuration of the pressure chamber 202, the bristle unit 190, which comprises the upper chamber section 206, is in its stowed position. This is the normal position of the bristle unit 190 when the floor tool 110 is not in use. On the other hand, when the pressure difference is relatively high the upper chamber section 206 is urged towards the lower chamber section 208, as indicated by arrow 216 in FIG. 15*a*, by atmospheric pressure acting against the biasing force of the resilient member 212 so that the pressure chamber 202 adopts a contracted configuration. In this configuration of the pressure chamber 202, the bristle unit 190 is in its deployed position.

Figure 10:
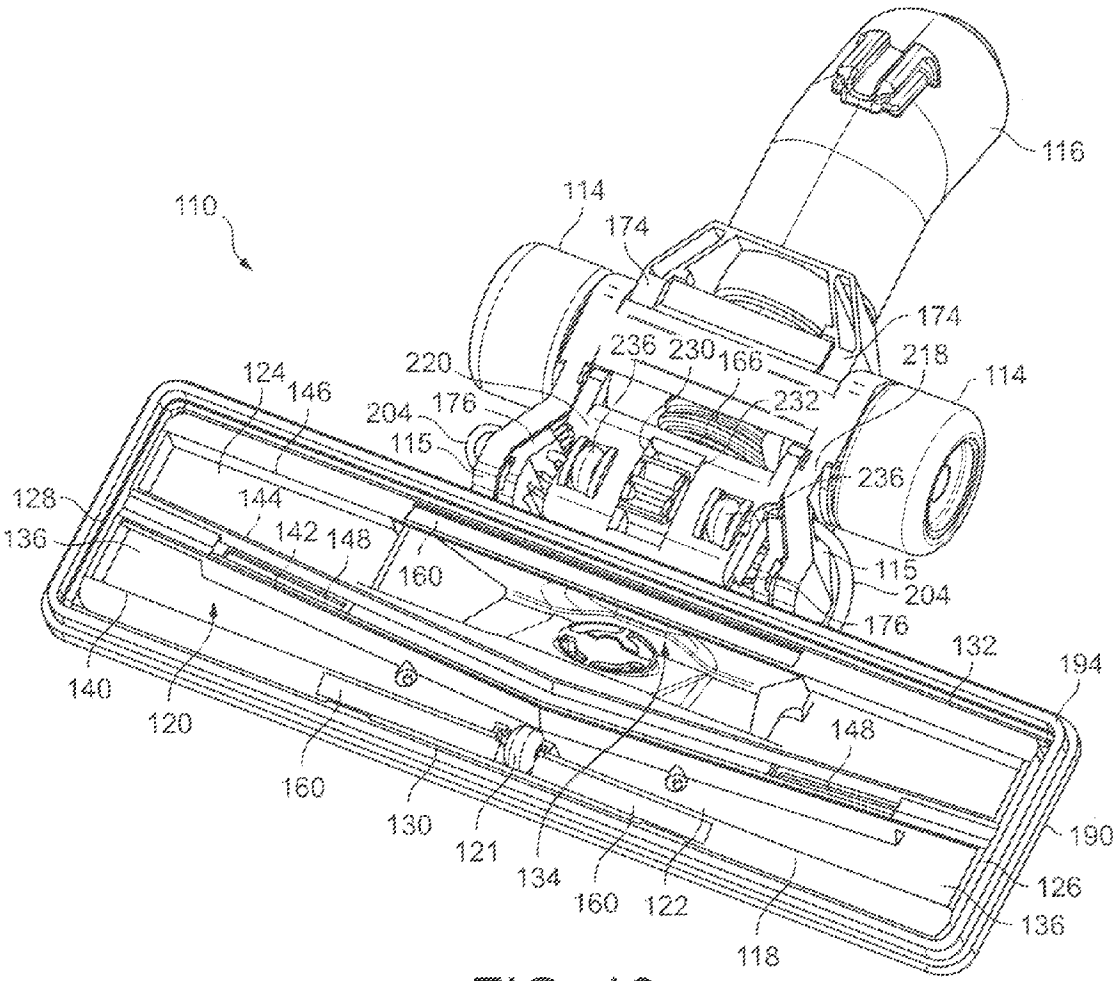
FIG. 10 is a bottom perspective view of the head of FIG. 9.
Figure 11:
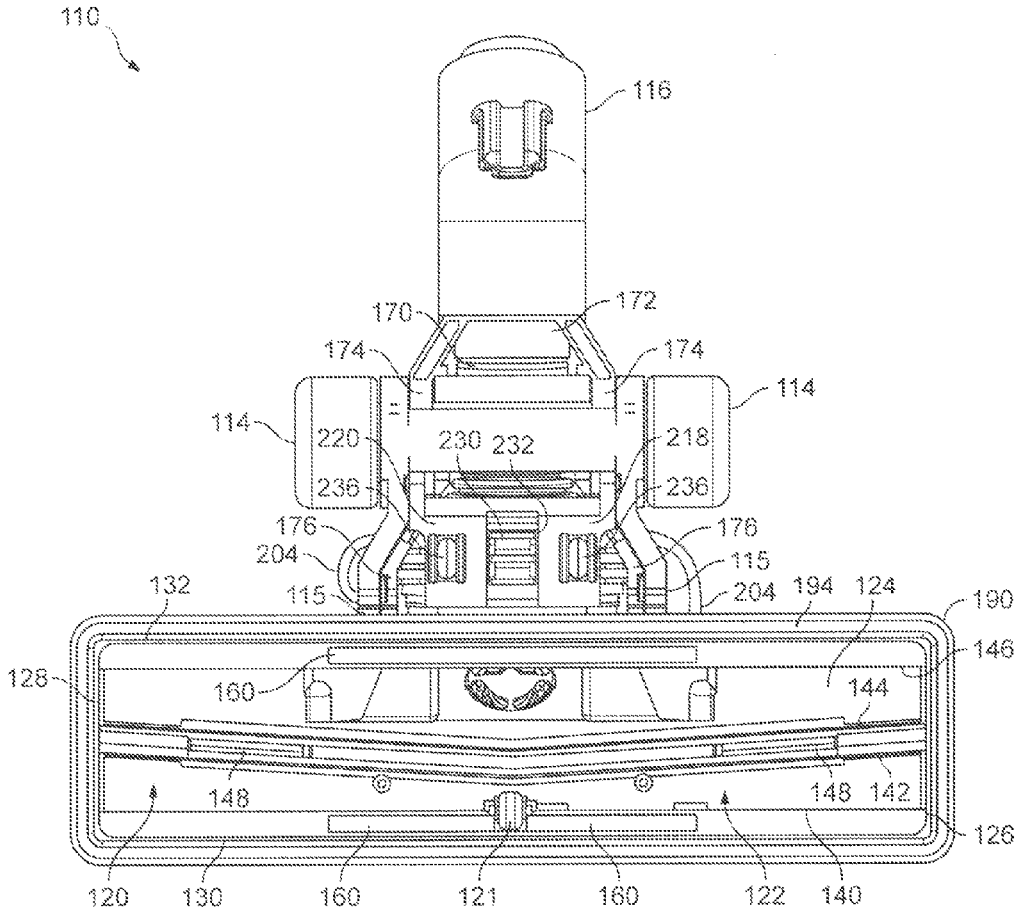
FIG. 11 is a bottom view of the head of FIG. 9.
Figure 12:
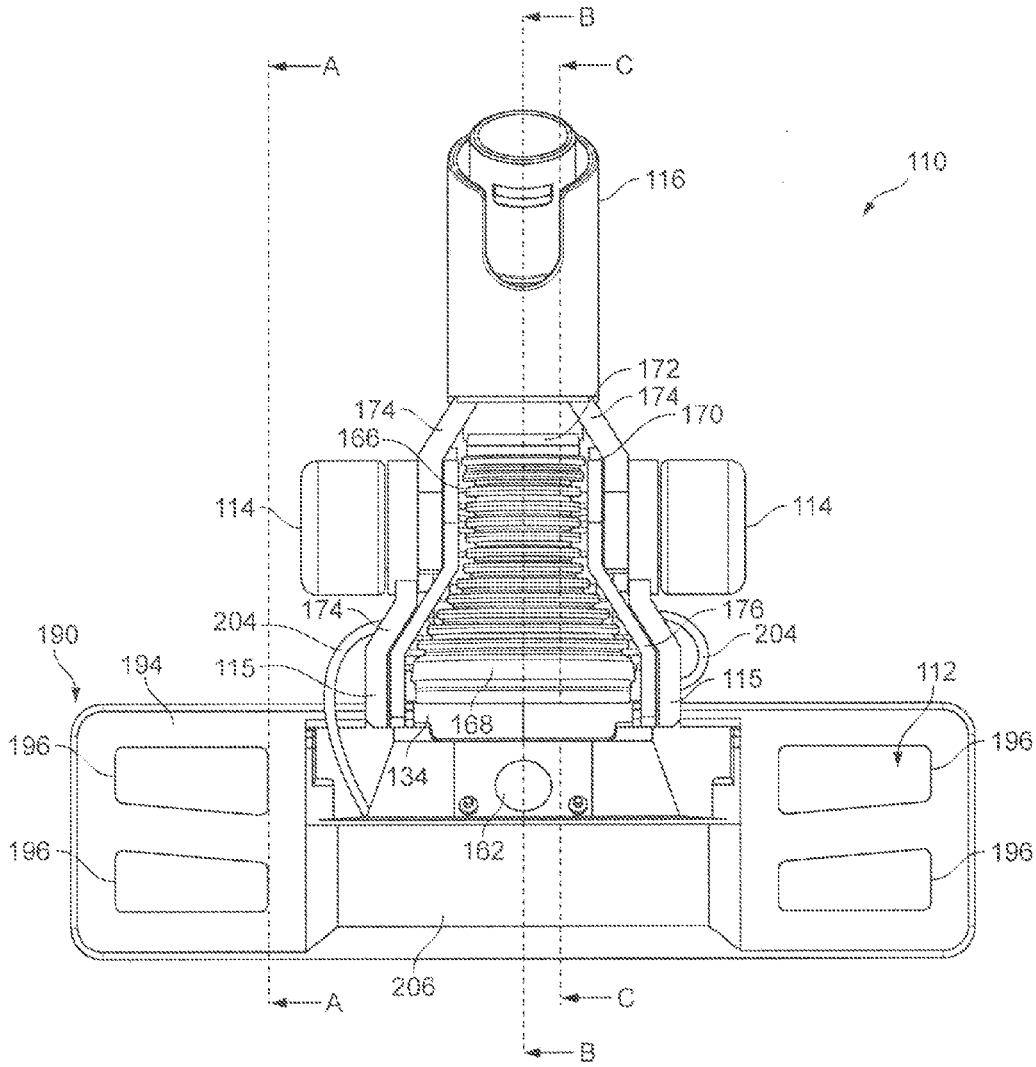
FIG. 12 is a top view of the head of FIG. 9.

The drive mechanism 200 comprises a control mechanism for varying the air pressure within the pressure chamber 202 by controlling the airflow through the fluid conduit 204. This control mechanism comprises a valve unit 218. With reference to FIGS. 10 and 11, the valve unit 218 is located beneath the hose 166. The valve unit 218 is connected to, and located between, the arms 115 of the main body 112 of the floor tool 110 so that the valve unit 218 is moveable relative to the main body 112. This allows the valve unit 218 is to be maintained in a substantially horizontal position as the floor tool 110 is maneuvered over a floor surface. In this example the valve unit 218 is pivotably mounted to the main body 112. Alternatively, the valve unit 218 may be moveable within the slots formed in the arms 115 of the main body 112. One or more springs (not shown) may be provided for biasing the valve unit 218 away from the hose 166, that is, towards a floor surface on which the floor tool 10 has been positioned.

The valve unit 218 comprises a housing 220 through which the fluid conduit 204 passes. The housing 220 contains a valve 222 for selectively opening and closing a fluid port 224 for exposing the fluid conduit 204 to the atmosphere. As illustrated in FIGS. 13*c* and 14*c*, the valve 222 is in the form of a piston moveable within a valve chamber 226 formed in the housing 220 of the valve unit 218. The valve 222 is moveable between a first position, illustrated in FIGS. 14*c* and 15*a* in which the fluid conduit 204 is open to the atmosphere, and a second position, illustrated in FIGS. 13*c* and 15*b*, in which the fluid conduit 204 is substantially isolated from the atmosphere. A flexible sealing member 228 may be located on the valve 222 for forming an air tight seal for isolating the fluid conduit 204 from the port 224.

The movement of the valve 222 between its first and second positions is actuated by a valve actuator 230. The valve actuator 230 is pivotably mounted within a recess 232 formed in the housing 220 of the valve unit 218 so that, in use, the valve actuator 230 protrudes from the valve unit 218 towards the floor surface to be cleaned. The valve actuator 230 is rotatable relative to the housing 220 of the valve unit 218 from a non-rotated position, illustrated in FIGS. 13*b* and 15*b*, and two rotated positions, one of which is illustrated in FIGS. 14*b* and 15*a*. The rotated positions of the valve actuator 230 are angularly spaced in different directions from the non-rotated position of the valve actuator 230. Springs (not shown) or other resilient elements are provided for biasing the valve actuator 230 towards its non-rotated position.

The valve actuator 230 is connected to a D-shaped cam 234 located within the valve chamber 226 for rotation therein. A spring (not shown) or other resilient member is provided for urging the valve 222 against the cam 234 so that rotation of the cam 234 within the valve chamber 226 causes the valve 222 to move between its first and second positions. With reference to FIGS. 13*b* and 13*c*, in the non-rotated position of the valve actuator 230, the valve 222 is in its second position. With reference to FIGS. 14*b* and 14*c* when the valve actuator 230 is in a rotated position the valve 222 is in its first position. The cam 234 thus serves to convert rotary movement of the valve actuator 230 to liner movement of the valve 222. Other suitable means for converting rotary movement of the valve actuator 230 to liner movement of the valve 222 will be readily apparent to the skilled person.

The valve unit 218 further comprises a pair of wheels 236 rotatably mounted within recesses located on opposite sides of the valve actuator 230. One or more additional wheels may be provided in front of, or behind, the valve actuator 230. The wheels 236 protrude downwardly from the lower surface of the housing 220 of the valve unit 218 beyond the valve actuator 230 so that when the floor tool 110 is located on a hard floor surface the valve actuator 230 is not in contact with that floor surface. The wheels 236 are relatively narrow in comparison to the wheels 114 and, to a lesser extent, in comparison to the wheel 121, so that when the floor tool 110 is located on a carpeted floor surface the wheels 236 sink at least partially into the pile of that floor surface to bring the valve actuator 230 into contact with that floor surface.

In use the floor tool 110 is attached to a vacuum cleaner 86, in a similar manner to the floor tool 10. When the user switches on the vacuum cleaner 86, the motor of the vacuum cleaner 86 is energized and drives a fan so as to draw in dirty air through the floor tool 110. Consequently, a relatively low air pressure is created in the suction cavity 120 and the outlet 134.

Figure 13A:
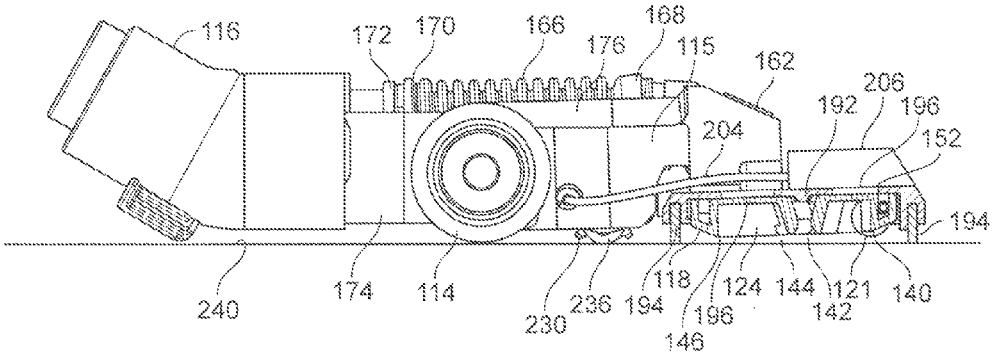
FIG. 13*a* is a side sectional view along line A-A in FIG. 12 with a brush unit of the head in a deployed position.
Figure 13B:
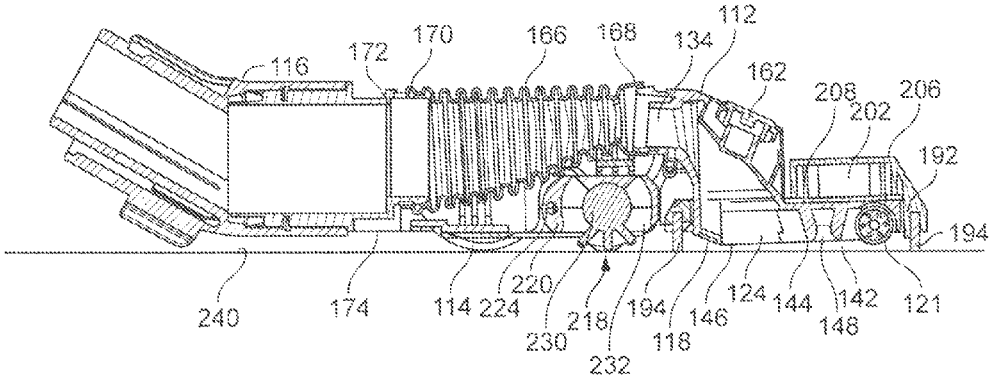
FIG. 13*b* is a side sectional view along line B-B in FIG. 12 with the brush unit of the head in a deployed position.
Figure 13C:
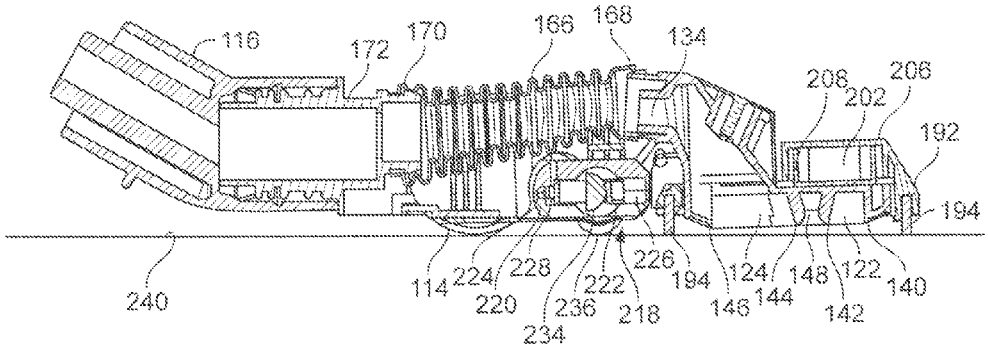
FIG. 13*c* is a side sectional view along line C-C in FIG. 12 with the brush unit of the head in a deployed position.

With reference to FIGS. 13*a*, 13*b* and 13*c*, when the floor tool 110 is in contact with a hard floor surface 240, the valve actuator 230 is spaced from the hard floor surface 240 by the wheels 236. Consequently, as the floor tool 110 is maneuvered over the hard floor surface the valve actuator 230 will be maintained in its non-rotated position under the action of the biasing springs acting thereon. In turn, the valve 222 will remain in its second position in which the fluid conduit 204 is substantially isolated from the fluid port 224. As a result, the air pressure within the pressure chamber 202 will be substantially the same as the air pressure within the outlet 134 of the suction cavity 120, and so a relatively large pressure difference will be generated between the air pressure in the pressure chamber 202 and the atmospheric pressure external to the pressure chamber 202. The upper chamber section 206 is urged towards the lower chamber section 208, as indicated by arrow 216 in FIG. 15*a*, by the atmospheric pressure acting against the biasing force of the resilient member 212 so that the pressure chamber 202 is held in its contracted configuration in which the brush unit 190 is in its deployed position.

As illustrated in FIG. 13*a*, in the deployed position of the brush unit 190 the bristles 194 protrude downwardly beyond the working edges 140, 142, 144, 146 of the main body 112 so that the working edges 140, 142, 144, 146 are spaced from the hard floor surface 240. This prevents the hard floor surface 240 from becoming scratched or otherwise marked by the working edges 140, 142, 144, 146 as the floor tool 110 is maneuvered over the floor surface 240. Furthermore, in the deployed position of the brush unit 190 the cover unit 192 engages the upper surface 152 of the main body 122, which causes the air slots 148 to be substantially isolated to the atmosphere by the parts of the cover 192 lying directly thereabove. This can enable a lower pressure to be generated within the suction cavity 120 during use of the floor tool 110, which can improve the entrainment within the airflow entering the suction cavity of dirt and debris located within crevices in the hard floor surface 240. The castellations (not shown) on the portion of the row of bristles 194 located adjacent the front edge 130 of the main body 112 allows debris located on the hard floor surface 240 to be drawn into the suction cavity 120 during a forward stroke of the floor tool 110 over the hard floor surface 240. Depending on the size of the gap between the working edges 140, 142, 144, 146 and the hard floor surface 240, this debris may pass, within the airflow, beneath the working edges 140, 142, 144 into the second suction channel 124, and from there to the outlet 134 of the suction cavity 120. Similarly, dirt and debris drawn from crevices in the hard floor surface 240 will also tend to enter directly to the second suction channel 124.

With reference also to FIGS. 14*a*, 14*b* and 14*c*, when the floor tool 110 is maneuvered onto a carpeted floor surface 250 the wheels 236 sink into the pile of the carpeted floor surface 250, causing the valve unit 218 to move downwardly relative to the main body 112 towards the carpeted floor surface 250. This brings the valve actuator 230 into contact with the carpeted floor surface 250. As the floor tool 110 is pushed over the carpeted floor surface 250 with a forward stroke, for example, the engagement between the valve actuator 230 and the carpeted floor surface 250 causes the valve actuator 230 to be rotated clockwise (as illustrated in FIG. 14*b*) to a first rotated position. The cam 234 within the valve chamber 226 rotates with the valve actuator 230 from the position shown in FIG. 13*c* to the position shown in FIG. 14*c* to push the valve 222 to its first position, shown in FIG. 14*c*. The movement of the valve 230 to its first position exposes the fluid conduit 204 to the fluid port 224, and thus to the atmosphere. Consequently, the air pressure within the pressure chamber 202 rises relative to the air pressure within the outlet 134 of the suction cavity 120, and so the difference between the air pressure in the pressure chamber 202 and the atmospheric pressure external to the pressure chamber 202 decreases. This enables the biasing force of the resilient element 212 to urge the upper chamber section 206 away from the lower chamber section 208, causing the brush unit 190 to move relative to the main body 112 from its deployed position to its stowed position.

As illustrated in FIG. 14*a*, in the stowed position of the brush unit 190 the bristles 194 are located above the working edges 140, 142, 144, 146 of the main body 112 so that the working edges 140, 142, 144, 146 come into contact with the carpeted floor surface 250 so as to provide an agitating action as the floor tool 110 is maneuvered over the carpeted floor surface 250. Furthermore, in the stowed position of the brush unit 190 the cover unit 192 is spaced from the upper surface 152 of the main body 122, which exposes the air slots 148. Consequently, air can be drawn through the windows 196 of the cover 192 and into the air slots 148. This air passes through the slots 148 and over the working edges 142, 144.

As the floor tool 110 is pushed forward over the carpeted floor surface 250, the airflow into and through the suction cavity 120 is similar to the airflow into and through the suction cavity 20 of the floor tool 10. The front working edges 140, 144 open out the pile of the carpet so that suction air can flow about the front working edges 140, 144 and into the suction channels 122, 124. Air is drawn under the front wall 130 of the main body 112, under the front working edge 140 and into the first suction channel 122 of the suction cavity 120. Air from the first suction channel 122 flows through the intermediate channels 136 into the second suction channel 124, and exits the suction cavity 120 through the outlet 134. Air is also drawn in through the air slots 148 from the atmosphere, under the front working edge 144 and into the second suction channel 124 of the suction cavity 120. Air from the second suction channel 124 exits the suction cavity 120 through the outlet 134.

When the floor tool 110 is drawn back along the carpeted floor surface 250, the pile of the carpeted floor surface 250 causes the valve actuator 230 to be rotated from its first rotated position to a second rotated position against the biasing force of the springs acting on the valve actuator 230. The second rotated position of the valve actuator 230 is substantially a minor image of the first rotated position. The rotation of the cam 234 as the valve actuator 230 moves between these two rotated positions causes the valve 222 to oscillate rapidly within the valve chamber 226 from its first position to its second position, and then back to its first position. As a result, the bristle unit 190 is maintained in its stowed position during the backward stroke of the floor tool 110. During this stroke, air is drawn in through the air slots 148 from the atmosphere, under the rear working edge 142 and into the first suction channel 122. Air from the first suction channel 122 flows through the intermediate channels 136 into the second suction channel 124, and exits the suction cavity 120 through the outlet 134. Air is also drawn under the rear wall 132 of the main body 112, under the rear working edge 146 and into the second suction channel 124. Air from the second suction channel 24 exits the suction cavity 120 through the outlet 134.

Thus, by providing the brush unit 190 and the drive mechanism 200 for moving the brush unit 190 automatically between stowed and deployed positions depending on the nature of the floor surface on which the floor tool 110 is being maneuvered, the configuration of the floor tool 110 can be optimised for pick up performance on both carpeted floor surface and hard floor surfaces.

The invention claimed is:

1. A surface treating head comprising a main body; a brush unit having an active state and an inactive state; and an actuating mechanism for actuating a transition of the brush unit between the inactive state and the active state comprising a housing, an actuator disposed on the housing and at least one surface engaging member disposed on the housing, the housing, the actuator and the at least one surface engaging member moveable as a unit relative to the main body, the actuator moveable relative to the housing through engagement with a surface to be treated and the at least one surface engaging member extending downwardly beyond the actuator.

2. The surface treating head of claim 1, wherein the at least one surface engaging member extends downwardly beyond the actuator by a distance in the range from 0.1 to 2 mm.

3. The surface treating head of claim 1, wherein the brush unit is moveable relative to the main body between the active state and the inactive state.

4. The surface treating head of claim 1, wherein the actuating mechanism comprises a pressure chamber and a system for varying the pressure within the chamber in response to movement of the actuator relative to the housing.

5. The surface treating head of claim 4, wherein the system for varying the pressure within the chamber comprises a valve, and wherein the actuator is configured to operate the valve.

6. The surface treating head of claim 5, wherein the actuator is pivotably moveable relative to the housing.

7. The surface treating head of claim 5, wherein the valve is moveable relative to the housing, and the housing comprises a cam for converting movement of the actuator relative to the housing into movement of the valve relative to the housing.

8. The surface treating head of claim 7, wherein the valve is biased towards the cam.

9. The surface treating head of claim 7, wherein the valve and the cam are located within a valve chamber of the housing.

10. The surface treating head of claim 4, wherein the pressure chamber has a variable volume, whereby a change in the volume of the pressure chamber causes the brush unit to move relative to the main body.

11. The surface treating head of claim 4, wherein the pressure chamber is located between the main body and the brush unit.

12. The surface treating head of claim 4, wherein the pressure chamber is located above the main body.

13. The surface treating head of claim 4, wherein the pressure chamber comprises an upper chamber section moveable relative to a lower chamber section.

14. The surface treating head of claim 13, wherein the upper chamber section is defined, at least in part, by the brush unit.

15. The surface treating head of claim 13, wherein the pressure chamber comprises an annular flexible sealing member located between the upper chamber section and the lower chamber section.

16. The surface treating head of claim 1, wherein the housing is connected to the main body.

17. The surface treating head of claim 1, wherein the main body comprises a suction cavity having an outlet.

18. The surface treating head of claim 17, comprising a flexible hose extending between the outlet and a connector, the housing being located beneath the flexible hose.

19. A surface treating head comprising a main body; a brush unit; and a drive mechanism for moving the brush unit relative to the main body between a stowed position and a deployed position, the drive mechanism comprising a pressure chamber and a valve unit for varying the pressure within the chamber, the valve unit comprising a housing, a valve located within the housing, an actuator disposed on the housing and at least one surface engaging member disposed on the housing, the housing, the actuator and the at least one surface engaging member moveable as a unit relative to the main body, the actuator moveable relative to the housing through engagement with a surface to be treated for operating the valve and the at least one surface engaging member extending downwardly beyond the actuator.

20. The surface treating head of claim 19, wherein, in the stowed position, the brush unit extends about the main body.

21. The surface treating head of claim 19, wherein the pressure chamber comprises a resilient element for urging the pressure chamber towards a configuration in which the brush unit is in a stowed position.

22. The surface treating head of claim 19, wherein the actuator is pivotably moveable relative to the housing.

23. The surface treating head of claim 19, wherein the valve is moveable relative to the housing, and the housing comprises a cam for converting movement of the actuator relative to the housing into movement of the valve relative to the housing.

24. The surface treating head of claim 23, wherein the valve is biased towards the cam.

25. The surface treating head of claim 23, wherein the valve and the cam are located within a valve chamber of the housing.

26. The surface treating head of claim 19, wherein the pressure chamber has a variable volume, whereby a change in the volume of the pressure chamber causes the brush unit to move relative to the main body.

27. The surface treating head of claim 19, wherein the pressure chamber is located between the main body and the brush unit.

28. The surface treating head of claim 19, wherein the pressure chamber is located above the main body.

29. The surface treating head of claim 19, wherein the pressure chamber comprises an upper chamber section moveable relative to a lower chamber section.

30. The surface treating head of claim 29, wherein the upper chamber section is defined, at least in part, by the brush unit.

31. The surface treating head of claim 29, wherein the pressure chamber comprises an annular flexible sealing member located between the upper chamber section and the lower chamber section.

32. The surface treating head of claim 19, wherein the housing is connected to the main body.

33. The surface treating head of claim 19, wherein the main body comprises a suction cavity having an outlet.

34. The surface treating head of claim 33, comprising a flexible hose extending between the outlet and a connector, the housing being located beneath the flexible hose.

* * * * *